US005285664A

United States Patent [19]

Chang et al.

[11] Patent Number: 5,285,664

[45] Date of Patent: Feb. 15, 1994

[54] AUTOMATIC WASHING MACHINES

[75] Inventors: Suk-Kyu Chang, Seoul; Sung-Bum Cho; Yong-Bum Shim, both of Suwon, all of Rep. of Korea

[73] Assignee: Tong Yang Cement Corp., Seoul, Rep. of Korea

[21] Appl. No.: 15,635

[22] Filed: Feb. 9, 1993

[30] Foreign Application Priority Data

Feb. 25, 1992 [KR] Rep. of Korea ..... 1992-2935

[51] Int. Cl.[5] ..... D06F 38/09; D06F 39/10

[52] U.S. Cl. ..... 68/18 F; 68/23.5; 68/207; 68/208

[58] Field of Search ..... 68/18 F, 23.5, 53, 207, 68/208

[56] References Cited

U.S. PATENT DOCUMENTS

| | | | |
|---|---|---|---|
| 3,006,477 | 10/1961 | Karecki | 68/18 F X |
| 3,653,807 | 4/1972 | Platt | 68/18 F X |
| 3,681,947 | 8/1972 | Cowan | 68/18 F |
| 3,742,736 | 7/1973 | Fish et al. | 68/23.5 |
| 4,184,347 | 1/1980 | Tobita et al. | 68/207 X |
| 4,434,630 | 3/1984 | Ikeda | 68/18 F |
| 5,092,141 | 3/1992 | Quinn | 68/23.5 X |

*Primary Examiner*—Philip R. Coe

*Attorney, Agent, or Firm*—Morgan & Finnegan

[57] ABSTRACT

An automatic washing machine having an improved structure. The sprinkling member for repeatedly sprinkling the washing water into the dehydrating tub comprises a removable washing tub lid, an adapter for permitting the washing water to be fed therethrough and a guide member forming, in cooperation with the washing tub lid, a sprinkling nozzle through which the washing water is sprinkled into the dehydrating tub. The lint filter filters off lints generated in the washing cycle and permits the filtered lints to be automatically removed therefrom so as to be drained off the washing machine along with the drained water. The circulation pump circulates the washing water and is connected to the washing tub and the sprinkling member in such a manner that it permits the washing water in the washing cycle to be drawn up to the sprinkling member through the lint filter and also permits the used washing water in the draining cycle to downwardly pass through the filter so as to be drained off the washing machine. This washing machine thus causes the detergent particles to be finely ground by the rotation of the pump impeller so as to be completely dissolved in the washing water and permits the lints generated in the washing to be filtered off and in turn automatically discharged therefrom.

5 Claims, 2 Drawing Sheets

AUTOMATIC WASHING MACHINES

BACKGROUND OF THE INVENTION

1. Field of the Invention

The present invention relates in general to automatic washing machines, and more particularly to an improved structure in such washing machines in which the washing water containing detergent particles is repeatedly drawn up to the upper part of a washing tub, at which the washing water is then evenly sprinkled onto the fabric articles inside a dehydrating tub, by a water circulation pump, thereby causing the detergent particles to be finely ground by the rotation of a pump impeller so as to be completely dissolved in the washing water and, as a result, improving the washing effect, and the lints generated in the washing is efficiently filtered off and in turn automatically discharged from the washing machine.

2. Description of the Prior Art

As well known to those skilled in the art, in clothes washing, irrespective of the washing type, that is, manual washing and mechanical washing, washing effect is achieved by virtue of a chemical separation of dirt from the clothes by means of the detergent as well as a mechanical separation of the dirt from the clothes caused by mechanical friction.

Various types of automatic washing machines have been proposed to improve the washing effect but have presented many difficult problems.

For example, there has been proposed a washing machine of the pulsator (agitator vane wheel) type as disclosed in U.S. Pat. Nos. 4,553,413 and 4,555,919. Each of the known washing machines disclosed in the U.S. patents comprises an agitator vane wheel which is disposed in the bottom of a dehydrating tub and agitates the fabric articles, particularly clothes, contained in the dehydrating tub which has a plurality of holes at its cylindrical side wall and is in turn mounted for rotation inside a washing tub.

However, in the known washing machines such as disclosed in the above U.S. patents, some of the detergent particles for use in the washing generally remains between an inner tub, i.e. the dehydrating tub, and an outer tub, i.e. the washing tub, during a washing cycle with its solid state remaining and is simply discharged from the washing machine during the next cycle, that is, the dehydrating and draining cycle. In result, the known washing machines have an disadvantage in that they requires to input much more amount of detergent exceeding a predetermined required amount thereinto in order to achieve desired washing effect. Particularly in the case of the washing of large loads of clothes, the known washing machine of the pulsator type causes some of the clothes disposed at the upper portion of the dehydrating tub to be scarcely agitated and, in this respect, impairs the chemical bond of the detergent to the dirt of the clothes as well as the mechanical friction of the clothes. Hence, the chemical and mechanical separation effect of the dirt from the clothes is inevitably reduced and this detrimentally affects the washing effect.

In addition, the known washing machine is generally provided with a filtering net for filtering off impurities, particularly lints generated in the washing, floating in the washing water. However, this type of known washing machine has a disadvantage in that its filtering net requires to be often manually treated in every washing so as to remove the impurities which were filtered off thereby.

SUMMARY OF THE INVENTION

It is, therefore, and object of the present invention to provide an automatic washing machine in which the abovementioned disadvantages can be overcome and which permits the inputted detergent particles for use in the washing to be sucked in a water circulation pump and to be finely ground by the rotation of an impeller of the water circulation pump so as to be completely dissolved in the washing water, thereafter, causes the washing water with the detergent dissolved therein to be in large quantities drawn up to the upper part, at which the washing water is then directly sprinkled onto the upper portion of the clothes being washed, of a washing tub, thereby improving the chemical separating effect of the dirt from the clothes, and improves mechanical frictional effect between the clothes being washed and the circulated washing water and this causes, in cooperation with the conventional agitating effect of the agitator, the washing effect to be substantially improved, thereby reducing required amount of the detergent and restricting the discharging amount of a pollutional material.

It is another object of the present invention to provide an improved structure of an automatic washing machine in which the detergent for use in the washing water is completely dissolved in the washing water so as to reduce the using amount of the detergent and the washing water with the detergent dissolved therein is evenly sprinkled onto the clothes being washed so as to beat the clothes and to lengthen the wave length of the washing water, thereby promoting the chemical and mechanical separation of the dirt from the clothes.

It is further object of the present invention to provide an improved structure of an automatic washing machine in which the impurities, particularly lints, floating in the washing water is filtered off by an automatically cleaned lint filter, which is disposed between the water circulation pump and an upper part of washing tub, by permitting the washing water to upwardly pass through the filter during a washing cycle so as to improve the filtering effect and the filtered impurities is then automatically discharged from the washing machine by driving the water circulation pump to rotate in the opposite direction so as to permit the used washing water to downwardly pass through the filter during a draining and dehydrating cycle, thereby making it possible to omit the manual removal of the impurities from the filter.

In order to accomplish the above objects, the present invention provides a washing machine comprising a housing having a control panel at its upper part, a power transmission being connected to a reversible drive motor by means of a drive belt and a driven pulley, a washing tub, an agitator vane wheel being rotatably mounted on an upper part of said power transmission, a dehydrating tub which has a plurality of through holes at its side wall and is disposed in said washing tub for rotation inside the washing tub and a water feed control valve being disposed on an upper part of the washing tub and being adapted to control the water feeding, the improvement comprising: sprinkling means for repeatedly sprinkling washing water into said dehydrating tub, said sprinkling means including a removable washing tub lid forming an upper part of said means and having a sprinkling guide surface, an adapter being provided at a side of said washing tub lid and permitting the washing water to be fed to said means therethrough and a guide member forming, in cooperation with the washing tub lid, a sprinkling nozzle through which the washing water is sprinkled into the dehydrating tub; lint filtering means for filtering off lints generated in the washing and permitting the filtered lints to be automatically removed therefrom so as to be then drained off the washing machine, said lint filtering means communicating with the washing tub and said adapter of the sprinkling means; and circulation pump means for circulating the washing water, said circulation pump means being connected to the washing tub and the sprinkling means in such a manner that it permits the washing water in washing cycle to be drawn up to the adapter of the sprinkling means through the lint filtering means and permits the used washing water in draining cycle to downwardly pass through the filtering means so as to be drained off the washing machine, thereby causing the lints in the washing water to be filtered off by the lint filtering means during the washing cycle and to be automatically removed from the lint filtering means during the draining cycle.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
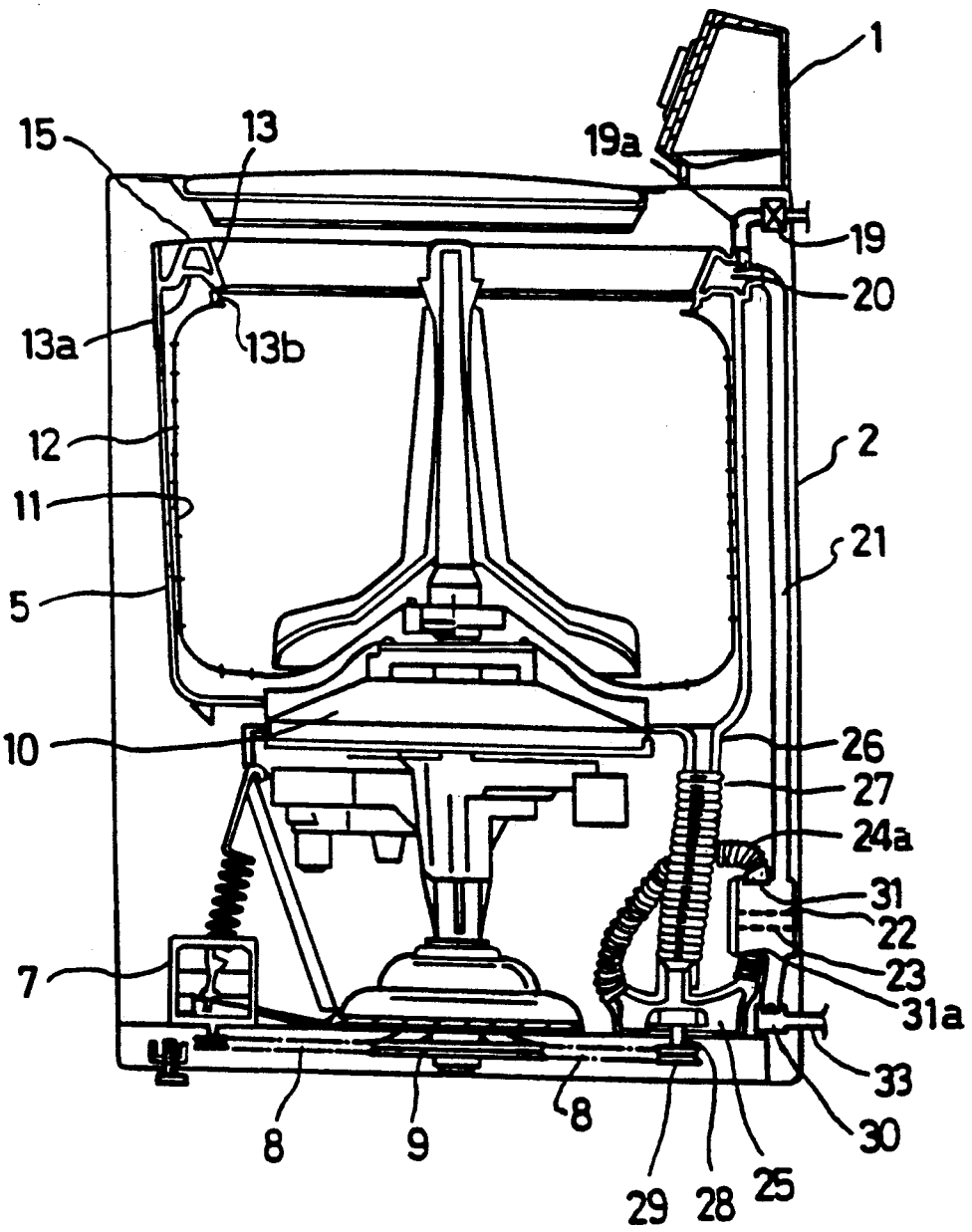
FIG. 1 is an elevational sectioned view of a washing machine in accordance with the present invention.
Figure 2:
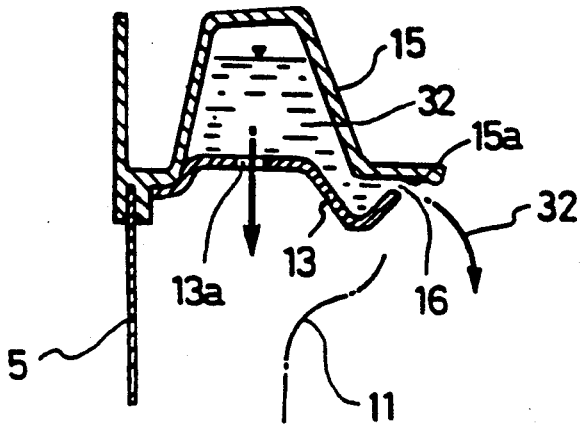
FIG. 2 is an enlarged sectioned view of a guide member of a washing tub of the washing machine of FIG. 1.
Figure 3:
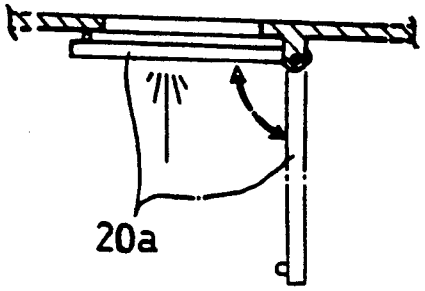
FIG. 3 is an enlarged sectioned view of a check valve of the washing machine of FIG. 1.
Figure 4:
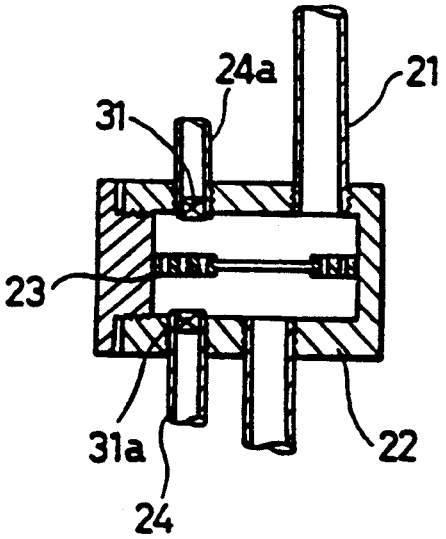
FIG. 4 is an enlarged sectioned view of an automatically cleaned lint filter of the washing machine of FIG. 1.

Referring to FIGS. 1 to 4, FIG. 1 shows a structure of a washing machine in accordance with the present invention, FIG. 2 shows a guide member of a washing tub, FIG. 3 shows a check valve and FIG. 4 shows an automatically cleaned lint filter.

As depicted in the drawings, the washing machine comprises a housing 2 having a back guard or a control panel 2 at its rear upper part and an agitator vane wheel 4 which is rotatably mounted on an upper part of a power transmission 3 which is in turn vertically disposed at the bottom center of the washing tub 5.

The power transmission 3 comprises a rotating shaft 6, which includes a gear and link assembly (not shown as it is well known to those skilled in the art) useful for permitting the agitator vane wheel 4 to rotate in the forward and reversed directions in accordance with predetermined cycles. The rotating shaft 9 of the power transmission 3 is provided at its lower end with a driven pulley 9 which is connected to a drive pulley of a motor 7 by means of a drive belt 8 supported therebetween. In addition, there is provided a connection member 10 so as to connect the agitator vane wheel 4 to the power transmission S. The washing tub 5 is mounted between the agitator vane wheel 4 and the connection member 10 and permits a dehydrating tub 11 , which has a plurality of through holes 12 at its cylindrical side wall, to be mounted on a power transmission hub 14 for rotation in the washing tub 5.

The washing tub 5 is covered with a removable washing tub lid 15, which has a sprinkling guide surface 15*a*, and constructed to have at its upper end an annular guide member 13 provided with an outer discharge slit 13*a* and an inner discharge periphery 13*b*. In addition, the inner discharge periphery 13*b* of the guide member 13 forms, in cooperation with the washing tub lid 15, a circumferential sprinkling nozzle 16. Additionally, at a side of the washing tub lid 15, an adapter 20 which is connected at an upper side thereof to a water feed pipe 19*a* and at a lower side thereof to a pump-side water feed pipe 21 (hereinafter, referred to simply as "the pump feed pipe") is disposed so as to permit the washing water to be fed therethrough. The adapter 20 is also provided with a check valve 20*a* for controlling the water flow direction.

The adapter 20 having the check valve 20*a* is connected to an automatically cleaned lint filter 22, which is disposed at a side of a lower part inside the housing 2 and equipped therein with a horizontal filtering net 23 as shown in FIG. 4, by means of the pump feed pipe 21. The lint filter 22 is also connected at its upper and lower ends to a water circulation pump 25 by mean of upper and lower tubes 24 and 24*a*.

The water circulation pump 25 is also connected to a drain port 26 of the bottom of the washing tub 5 by means of a drain hose 27. The water circulation pump 25 is applied with the drive power of the drive motor 7 through a drive belt 8 supported between the driven pulley 6 of the power transmission 3, which is also applied with the drive power of the drive motor 7 by means of its own drive belt 8 as described above, and a pump-side driven pulley 29 mounted on a rotating shaft 28 of the pump 25. On the other hand, the lint filter 22 is connected at its lower end to a drain valve 30 by means of a drain valve connection pipe 30*a* and equipped at its upper and lower ports, at which the upper and lower tubes 24 and 24*a* are connected to the lint filter 22, with a check valve 31 or 31*a*, respectively.

As well known to those skilled in the art and depicted in FIG. 3, the aforementioned check valves 20*a*, 31 and 31*a* are constructed such that they are selectively open the corresponding hydraulic lines depending upon the flow direction of the washing water.

In the drawings, the reference numeral 19 denotes a water feed control valve, 32 denotes the washing water and 33 denotes a drain pipe through which the used washing water is drained off the washing machine.

In operation, the washing machine having the aforementioned construction sequentially carries out various cycles in the order of water feeding→washing→draining, dehydrating and showering→water feeding→first rinsing→draining and dehydrating→second rinsing→draining and dehydrating→third rinsing→draining and dehydrating.

First, the washing water 32 is fed from the outside to the space, which is formed between the washing tub lid 15 and the guide member 13 of the washing tub 5, by way of the water feed control valve 19, the water feed pipe 19*a*, the check valve 20*a* and the adapter 20, sequentially. At this time, the downward water flow toward the adapter 20 causes the check valve 20*a* to be turned counterclockwise about its hinged connection so as to permit the water feed pipe 19*a* to communicate with the inside of the adapter 20 but to block the pump feed pipe 21. The washing water 32 having been introduced into the space between the washing tub lid 15 and the guide member 13 is then sprinkled into the dehydrating tub 11 through the sprinkling nozzle 16 until a predetermined water level determined in accordance with the clothes load inside the dehydrating tub 11 is achieved. When the predetermined water level inside the washing tub 5 is achieved, the water feed control valve 19 blocks the water feed pipe 19*a* so as to stop the water feeding and the drive motor 7 starts its rotation in the forward direction so as to cause the forward directional drive power thereof to be transmitted to the power transmission 3 by way of the drive belt 8 and the driven pulley 9. In result, the power transmission 3 comprising the rotating shaft 6 including the gear and link assembly permits the agitator vane wheel 4, which is mounted on the upper part of the power transmission 3 as described above, to rotate in the forward and reversed directions in accordance with the predetermined forward and reversed directional cycles, thereby agitating the clothes inside the dehydrating tub 11.

At this time, the forward directional drive power of the drive motor 7 is also transmitted to the water circulation pump 25 by way of the drive belt 8 supported between the driven pulley 9 of the power transmission 3 and the pump-side driven pulley 29 of the circulation pump 25, thereby driving the circulation pump 25 in the forward direction. At the same time, the washing water 32, in which the impurities such as lints float, is continuously discharged from the washing tub 5 to the circulation pump 25 through the drain port 26 and the drain hose 27. Upon receiving the washing water 32 discharged from the washing tub 5, the water circulation pump 25 compresses the washing water 32 and permits the compressed washing water 32 to be drawn up to the adapter 20 of the washing tub lid 15 through the lower tube 24, the automatically cleaned lint filter 22, the pump feed pipe 21 and the check valve 20*a* of the adapter 20, sequentially. In this case, the lower-side check valve 31*a* is opened while the upper-side check valve 31 is closed. Also, the detergent particles in the washing water 32 are finely ground as they contact with the rotating impeller of the water circulation pump 25 and this improves solubility of the detergent in the washing water 32.

During the drawing up of the compressed washing water 32 to the adapter 20 of the washing tub lid 15 by the water circulation pump 25, the lints in the washing water 32 are efficiently filtered off by the horizontal filtering net 23 of the lint filter 22 as the washing water 32 upwardly passes through the filtering net 23.

On the other hand, the compressed washing water 32 having been drawn up to the upper part of the washing tub 5 is then sprinkled under a pressure onto clothes inside the dehydrating tub 11 through the sprinkling nozzle 16 with the sprinkled water being guided by the guide surface 15*a* of the washing tub lid 15. Here, the guide surface 15*a* of the lid 15 is preferred to be downwardly inclined at its inner end so as to stably guide the sprinkled washing water 32 into the dehydrating tub 11. On the other hand, the sprinkling of the washing water 32 is evenly carried out over the whole inner circumferential periphery of the lid 15 as if to be carried out by a waterspout, thereby providing the clothes with beating effect, lengthening the wave length of the washing water, promoting complete dissolution of the detergent in the washing water and, in this respect, efficiently restricting occurrence of foam.

When the washing cycle ends, the drive motor 7 stops its rotation and this causes the power transmission 3 and the water circulation pump 25 to temporarily stop their operations. Also, the drain valve 30 is opened so as to permit the washing water 32 inside the washing tub 5 to be drained off the washing machine. If the water level in the washing tub 5 is lowered to a predetermined level, for example, about one third of the initial water level, as the washing water 32 is drained off the washing machine as described above, the drive motor 7 starts its rotation in the reversed direction and this causes the power transmission 3 to drive the dehydrating tub 11 so as to dehydrate the clothes. The reversed directional rotation of the drive motor 7 also permits the water circulation pump 25 to rotate in the reversed direction following suit, thereby causing the washing water 32 having been discharged from the washing tub 5 to the water circulation pump 25 to be drained off the washing machine by way of the lint filter 22 in such a manner that it flows in the lint filter 22 in the opposite direction to that in the case of the washing cycle. That is, the washing water 32 is introduced to the lint filter 22 through the upper tube 24*a* and downwardly passes through the lint filter 22 so as to be drained off the washing machine through the opened drain valve 30 and the drain pipe 33. At this time, the upper-side check valve 31 of the lint filter 22 is opened while the lower-side check valve 31*a* is closed. Also, as the washing water 32 downwardly passes through the lint filter 22 as aforementioned, the impurities, particularly lints, which were filtered off by the filtering net 23 during the prior washing cycle and have been attached to the under surface of the filtering net 23, are removed from the net 23 and drained off the washing machine along with the washing water 32.

During dehydrating the clothes, to cause the dirt and foam remaining between the washing tub 5 and the dehydrating tub 11 and also inside the dehydrating tub 11 to be carried down, the showering cycle is carried out. In this showering cycle, the water feed valve 19 opens the water feed pipe 19*a* so as to permit the outside water to be newly fed to the adapter 20 and in turn to be introduced into the space between the washing and dehydrating tubs 5 and 11 through the outer discharge slit 13*a* of the guide member 13 and also into the dehydrating tub 11 through the sprinkling nozzle 16. In result, it is possible to clean the washing tub 5 and the dehydrating tub 11 prior to the next rinsing cycle wherein the clothes after the dehydrating cycle is rinsed in the same manner as described in the case of the aforementioned washing cycle. Such a rinsing cycle is carried out three times over a washing operation with draining and dehydrating cycles, each carried out after each rinsing cycle, thereby improving the washing effect.

As described above, the present invention provides a washing machine which permits the washing water in the washing operation to be continuously, repeatedly circulated by a water circulation pump so as to be drawn up to an upper part of the washing tub, thereby causing the detergent particles for use in the washing cycle to be finely ground by the rotation of the pump impeller so as to be completely dissolved in the washing water and, as a result, improving the washing effect owing to the improvement of the chemical separation of dirt from the clothes. In addition, the washing water drawn up to the upper part of the washing tub is then directly sprinkled under a pressure onto the upper portion of the clothes inside the dehydrating tub through a circumferential sprinkling nozzle which is formed between the washing tub lid and the guide member of the washing tub so that the present washing machine imparts beatening effect to the clothes, lengthens the wave length of the washing water and causes the detergent to be completely dissolved in the washing water so as to restrict occurrence of foam.

On the other hand, during a showering cycle carried by the present washing machine, the washing machine permits water to be newly introduced to a space between the washing tub and the dehydrating tub and also to the dehydrating tub wall through an outer discharge slit of the guide member and the sprinkling nozzle, respectively, thereby making it possible to clean the washing tub and the dehydrating tub prior to the next rinsing cycle. Furthermore, the present invention provides an improved structure of lint filter of the washing machine in which the lint floating in the washing water is efficiently filtered off by a filtering net of the filter during a washing cycle, thereafter, automatically removed from the filtering net and drained off the washing machine together with the drained washing water during a draining and dehydrating cycle by reversing the water flow direction.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A washing machine comprising a housing having a control panel at its upper part, a power transmission being connected to a reversible drive motor by means of a drive belt and a driven pulley, a washing tub, an agitator vane wheel being rotatably mounted on an upper part of said power transmission, a dehydrating tub which has a plurality of through holes at its side wall and is disposed in said washing tub for rotation inside the washing tub and a water feed control valve being disposed on an upper part of the washing tub and being adapted to control the water feeding, the improvement comprising:

sprinkling means for repeatedly sprinkling washing water into said dehydrating tub, said sprinkling means including a removable washing tub lid forming an upper part of said means and having a sprinkling guide surface, an adapter being provided at a side of said washing tub lid and permitting the washing water to be fed to said means therethrough and a guide member forming, in cooperation with the washing tub lid, a sprinkling nozzle through which the washing water is sprinkled into the dehydrating tub;

lint filtering means for filtering off lints generated in the washing and permitting the filtered lints to be automatically removed therefrom so as to be then drained off the washing machine, said lint filtering means communicating with the washing tub and said adapter of the sprinkling means; and circulation pump means for circulating the washing water, said circulation pump means being connected to the washing tub and the sprinkling means in such a manner that it permits the washing water in washing cycle to be drawn up to the adapter of the sprinkling means through the lint filtering means and permits the used washing water in draining cycle to downwardly pass through the filtering means so as to be drained off the washing machine, thereby causing the lints in the washing water to be filtered off by the lint filtering means during the washing cycle and to be automatically removed from the lint filtering means during the draining cycle.

2. A washing machine according to claim 1, wherein said guide member of the sprinkling means is provided with an outer discharge slit for permitting the washing water to be introduced to a space between said washing tub and said dehydrating tub and the washing water sprinkled from said sprinkling nozzle is guided by said sprinkling guide surface of the washing tub lid.

3. A washing machine according to claim 1, wherein said lint filtering means is provided therein with a filtering net.

4. A washing machine according to claim 1, wherein said lint filtering means is provided at its upper and lower parts with a check valve, respectively.

5. A washing machine according to claim 1, wherein said lint filtering means is connected at its lower end to a drain valve.

* * * * *